United States Patent [19]

Johns

[11] Patent Number: 4,635,986

[45] Date of Patent: Jan. 13, 1987

[54] LINE HANDLING DEVICE

[76] Inventor: Richard B. Johns, 1306 Lake Joanna Dr., Eustis, Fla. 32726

[21] Appl. No.: 803,730

[22] Filed: Dec. 2, 1985

[51] Int. Cl.[4] ..... B63B 21/04

[52] U.S. Cl. ..... 294/19.1; 114/221 R

[58] Field of Search ..... 294/19.1, 19.2, 19.3, 294/82.24, 82.25; 114/221 R, 230; 119/151, 153, 154

[56] References Cited

U.S. PATENT DOCUMENTS 3,828,716 8/1974 Bernardi ..... 294/19.1

3,945,335 3/1976 Kratz ..... 294/19.1

*Primary Examiner*—James B. Marbert

*Attorney, Agent, or Firm*—Alvin S. Blum

[57] ABSTRACT

A device for holding open and manipulating an end loop of a boat line at an extended distance from the user, especially for positioning the loop over a cleat or the top of a piling to dock a boat. The device attaches to a long pole such as a boat hook. It comprises a wire support and a wire forming a V shape in a first, operational mode. At the free ends of the V, the wire is shaped into releasable rope-holding hooks. In operation, the rope loop is held by these hooks while the operator applies tension to the rope along the pole. The loop forms a triangle, bounded on two sides by the wire, with the third side free. The triangle is slipped over the piling and the pole retracted. The piling passes through the open side of the wire triangle and the rope releases from the wire hooks. In a second mode, the wire is retracted and the ends brought together for convenient storage and to permit use of the pole for other purposes such as a boat hook and the like. The device may be adapted for applying a tail rope to a large fish, or an animal that might be dangerous to handle at close quarters.

11 Claims, 9 Drawing Figures

FIG. 4
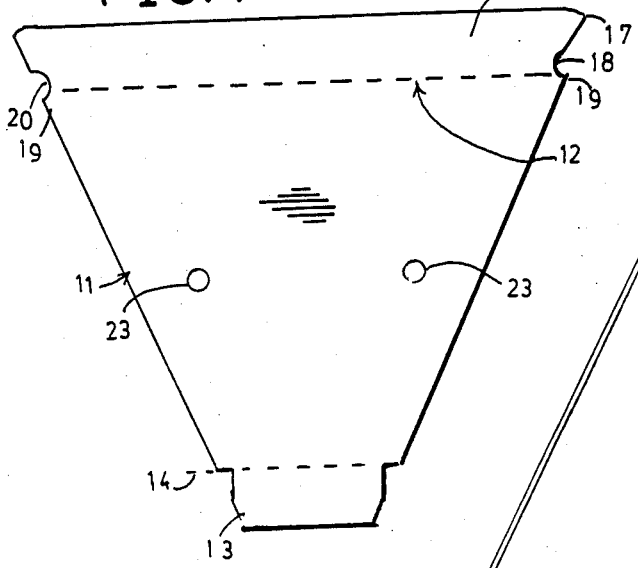
FIG. 6
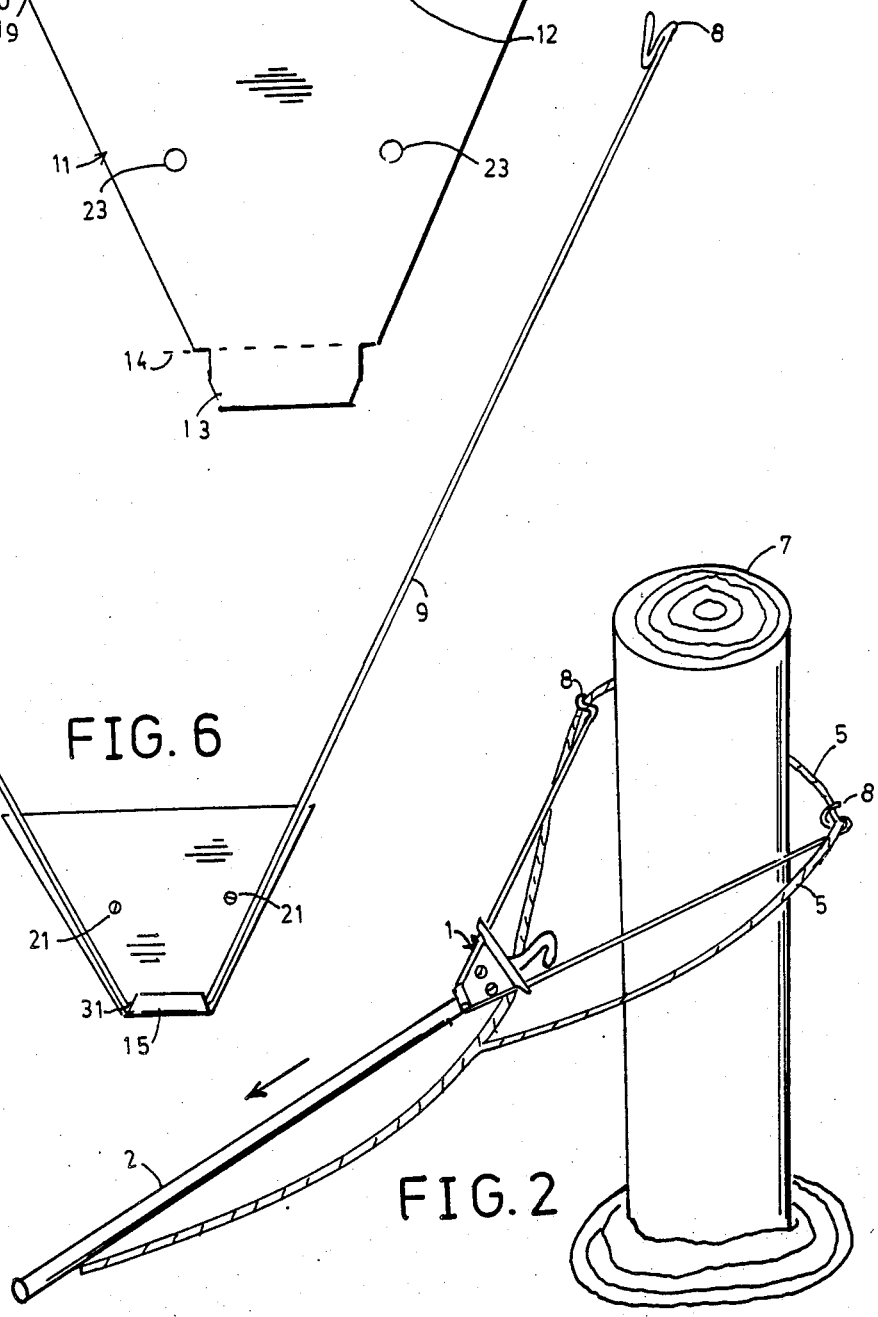
FIG. 2

LINE HANDLING DEVICE

FIELD OF THE INVENTION

The present invention relates to boat line handling and more particularly to apparatus to place the terminal loop of a line around an object at a distance from the user, as in securing a boat to a piling.

DESCRIPTION OF THE PRIOR ART

There have been many inventions directed to the general problem of securing a line to an object at a distance from the user as disclosed by the following U.S. Pat. Nos.: 2,730,985; 2,811,127, 2,677,597; 3,774,953; 3,677,597; 3,841,685; 3,918,385; 3,945,335; 4,261,280; 4,519,643.

None of these prior inventions are seen to anticipate the instant invention.

BRIEF SUMMARY OF THE INVENTION

The present invention relates to an improved arrangement for positioning an end loop of a boat line around an object at a distance from the user as in placing an eye splice of a docking line over a cleat or over the top of a piling that is beyond normal reach. The apparatus of the invention is attachable to a long pole which may have other utility such as a boat hook, gaff hook, push-pole and the like. The device provides two positions, a first, operating position and a second, storage position. In the first, operating position, the free ends of a V-shaped wire are held extended beyond the end of the pole with the apex of the V directed toward the user. The free ends of the wire terminate in releasable line-holding means. In use, the line loop is held by these two line-holding means while the operator applies tension to the line along the pole. The held loop forms a triangle, bounded on two sides by the wire, with the third side free. The triangle is passed over the piling and the pole retracted. The piling passes through the open side of the wire triangle and the line is pulled loose from the line holding means. This operation leaves the line loop around the piling and the line handling device free of the line. The triangular shape imparted to the line loop by the V-shaped wire is of such dimension to permit the loop to readily pass over the piling. In the second, storage position, the device is so retracted that it does not interfere with other intended use of the pole. In this position, the wire no longer forms a V-shape, and it no longer extends beyond the end of the pole. The storage position provides the advantages of the line handling device without requiring the cost and storage problems of an additional long pole aboard just for line handling.

The V-shaped wire is held in place on the pole by a wire holding bracket. The bracket maintains the V-shape of the wire extended beyond the pole in the first position. It maintains the wire in the second position wherein the wire does not extend beyond the pole, and the wire ends of the V are brought together so that wire does not substantially increase the thickness of the pole. When the device is employed to apply a snare such as a tail rope on a fish, the loop is formed with a sliding knot that can be pulled up snug after fitting it over the tail.

The design provides fast and easy change between first and second positions and permits fast and easy application to a line to facilitate the docking maneuver.

These and other objects and advantages of the invention will become evident from the detailed descriptions of the preferred embodiments of the invention which follow.

BRIEF DESCRIPTION OF THE DRAWINGS

FIG. 2 is a fragmentary perspective view of the device in use, with the loop in place on a piling.

FIG. 4 is a plan view of the wire holding plate before bending into final shape.

FIG. 6 is a fragmentary plan view of the plate with wire in operating position.

DETAILED DESCRIPTION OF THE PREFERRED EMBODIMENTS

Figures 1, 3:
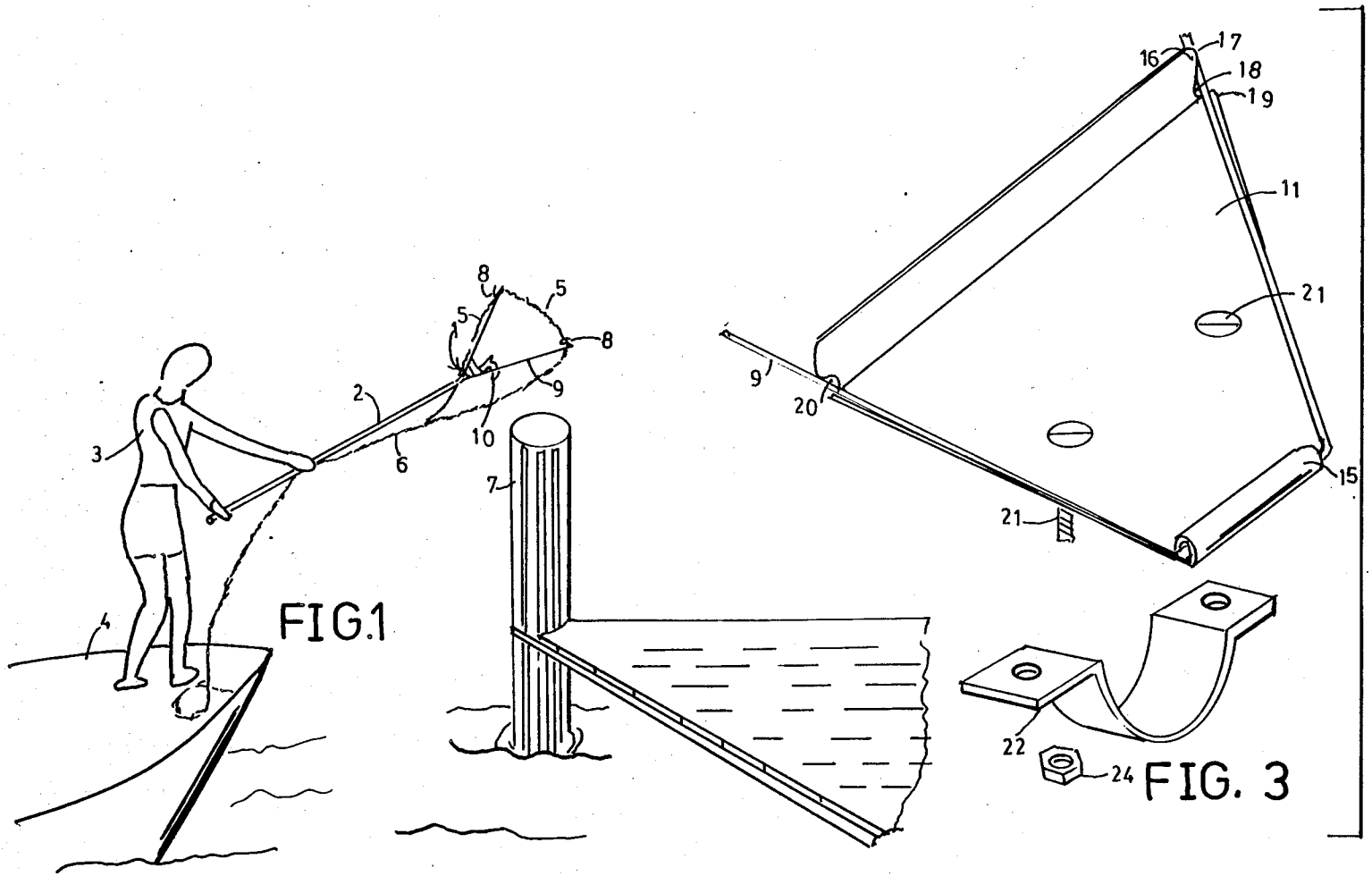
FIG. 1 is a perspective view of the device in use with the line loop positioned above a piling.
FIG. 3 is a perspective view of the wire holding plate.
Figure 5:
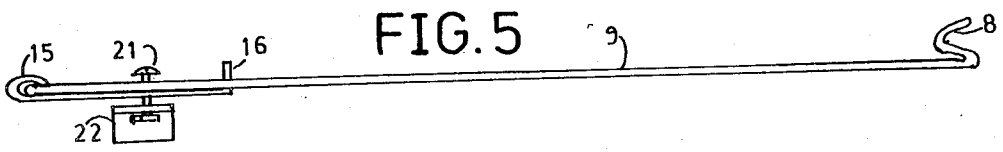
FIG. 5 is a side elevation view of the plate with wire in operating position.
Figure 7:
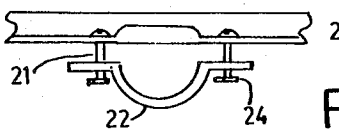
FIG. 7 is a rear elevation view of the plate without the wire.
Figure 8:
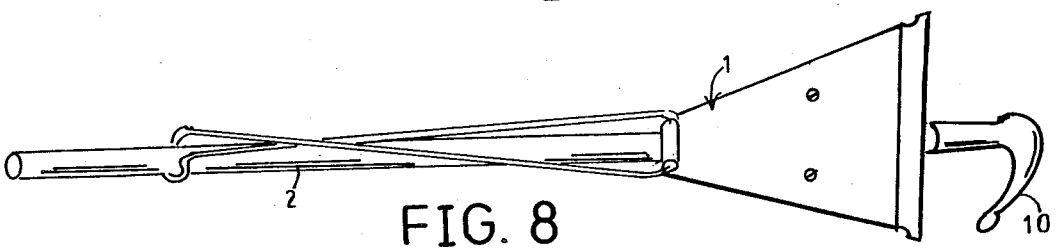
FIG. 8 is a perspective view of the device in storage position.

Referring now to the drawings, FIG. 1 illustrates how the device 1, fastened to the pole 2 of a boat hook is used by an operator 3 on boat 4 to position the loop 5 on line 6 over the piling 7. The two line hooks 8 at the free ends of the V shaped wire 9 hold the loop open so that it can pass freely over the piling, while the line 6 is held by the operator with the pole 2 to apply slight tension to hold the loop in the hooks. After the loop has been positioned on the piling as shown in FIG. 2, the pole can be pulled back to the boat by motion in the direction indicated by the arrow. Since the loop 5 now encircles the piling, it will pull free from the hooks 8 and remain around the piling, leaving the device 1 ready to be used on another line. A line is installed on the device by simply applying the loop over the two hooks 8 formed at the free ends of the wire "V" 9 and applying tension on the line 6 as it is laid alongside the pole. This forms the loop 5 into a triangle bounded on two sides by the wire "V" which may be positioned horizontally for use without collapsing or dropping off. The triangle so formed is large enough to fit over the piling, and it extends sufficiently beyond the boat hook end 10 to prevent the boathook from interfering with the line handling function. Details of construction are shown in FIGS. 3–7. FIG. 4 shows a flat metal plate 11. This is shaped to become the wire holding plate by bending 90° at line 12 to form the wire spreading and holding element 16, and by bending the end piece 13 at line 14 through more than 180° with a gap to form a partial cylinder around a straight portion 31 of the wire 9 at the apex of the "V" to act as a hinge for the rotation of wire 9 between first operating and second storage positions. The wire holding plate 11 is shown in the final form in FIG. 3 with the wire in the first, operating position. The wire V is formed of a springy metal. In its relaxed state it forms a V shape with a flat apex fitting within hinge 15. The V formed is narrower than the V shown in FIG. 3. When the wire is rotated in hinge 15 from the storage position to the operating position shown in FIG. 3, the sides of the "V" are springably forced apart to pass by the upper, wider portion 17 of the wire spreading and holding element 16. The sides spring together to fit into the narrower lower portion 18, of the vertical element 16, pressing and holding the wire against the wider horizontal base portion 19. Alternatively, the edge of element 16 may have a notch 20 as shown on the left side of FIG. 4. The plate 11 is secured to the pole 2 by screws 21 in screw holes 23 drawing up clamp 22 with nuts 24 or by other clamping means well known in the art. The hooks 8 in the ends of the wire 9 may be formed by bending each wire end into a hook shape. The device is placed in the storage position by lifting the wire out of the holding element 16, and rotating it 180° in hinge 15 so that the hook ends 8 are now away from the boathook end 10 as shown in FIG. 8. The wire ends are brought together and crossed over each other as shown and then brought underneath pole 2 and hooked together. The springy nature of the wire pulls the hooks against each other, holding the ends together and the wire closely wrapped around the pole so that the pole may be used for other purposes or stored without interference from the wire.

There are multi-function boat poles that are adapted to receive a plurality of different interchangeable useful end elements such as boat hook, gass, net and the like. These are generally attached to the pole by a screw thread. The device 11 of the invention may be permanently fastened to a short length of threaded rod to perform as one of the interchangeable end elements.

Figure 9:
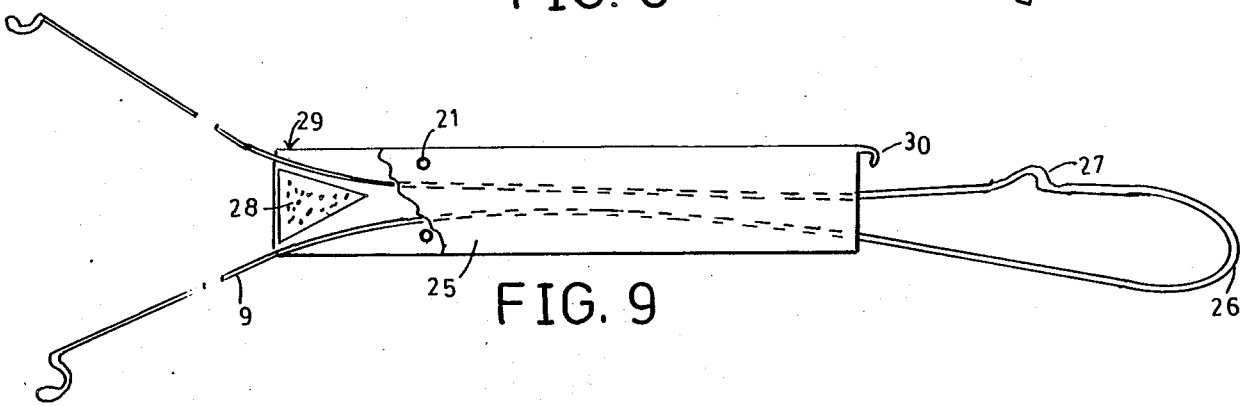
FIG. 9 is a fragmentary plan view of the device with a tubular wire holder.

In the alternative embodiment of the invention shown in FIG. 9, the wire 9 is moved between the operating position and the storage position by sliding within the tubular sleeve 25 by pushing or pulling the end bight 26 of the wire. As bight 26 is pushed toward the sleeve 25, the two sides of the wire converge as they pass screws 21, thereby forming the apex of the "V" and the free, distal ends of the wire are directed apart by the wedge-shaped insert 28 within sleeve 25.

A portion of the cover 29 of the sleeve has been broken away to reveal the wedge in place. A notch-like bend 27 in the wire bight is springably engaged by the hook portion 30 of sleeve 25 in the operating position. This holds the position of the wire in the sleeve, preventing the wire from retracting when the line loop is in place and tension is applied to the line. Squeezing the bight together disengages the notch and permits pulling bight 26 away from sleeve 25 causing the ends to be retracted and pulled together into a storage position.

What is claimed is:

1. A device for holding open a line loop at the end of a boat line and for extending and positioning said loop a substantial distance from the user to encircle an object, comprising:

a substantially V-shaped wire element having releasable line holding means at the two free ends of said V shape;

wire element support means having hinge means at a first end and wire holding means at a second end, said hinge means rotatably holding said wire element at the apex of the V, thereby permitting said wire element to rotate substantially 180° about said hinge from a first, operating position to a second, storage position, said wire holding means for releasably holding the two legs of said wire element apart to maintain the V shape and affixed to said wire element support means in said first operating position, said wire holding means further for releasing said legs of said wire element to permit said wire element to be rotated 180° about said hinge means to a second, storage position;

pole clamping means connected to said wire element support means for clamping said device substantially at the end of a long pole with a major portion of said wire element extending beyond the end of said pole when said device is in said first, operating position, wherein said wire element is for holding the ends of said V together after the legs of said wire element are wrapped around said pole in said second, storage position to facilitate storage and alternate use of said pole, said wire element support means formed by plate means, said wire holding means formed by forming a second end of said plate means substantially orthogonally to the body of said plate means, the sides of said second end being wider than said V-shaped wire element in its relaxed state and of reduced width closer to said body of said plate means to permit said wire holding by the spring tension of said wire element when it is spread apart to fit outside of the outer edges of said second end in said first, operating position.

2. The device of claim 1, further comprising said releasable line holding means formed by bending the ends of said wire element into line holding hooks.

3. The device of claim 1, including notch means in the outer edges of said second end for further holding of said wire element.

4. The device of claim 1, further comprising means for releasably holding said line loop in said line holding means at the two free ends of said V-shaped wire element to form said loop into substantially a triangle when said boat line is held alongside said pole in said first, operating position.

5. The device of claim 4, wherein the plane of the V of said V-shaped wire element and the plane of said triangle are substantially parallel to the long axis of said pole.

6. The invention of claim 1 further including said hinge means formed by forming a first end of said plate means into a partial cylinder about a straight portion of said wire element at the apex of said V-shape.

7. A device for holding open a line loop at the end of a line and for extending and positioning said loop a substantial distance from the user to encircle an object comprising:

a substantially V-shaped wire element having releasable line holding means at the two free ends of said V shape;

tubular wire element support means providing axial movement of said wire element between a first, operating position and a second, storage position, said wire element support means disposed to direct and hold said wire element in a V-shape, with the plane of said V shape substantially parallel to said tubular wire element support means in said first, operating position;

pole clamping means connected to said wire element support means for clamping said device substantially at the end of a long pole with a major portion of said wire element extending beyond the end of said pole when said device is in said first, operating position, said wire element support means further disposed for drawing said ends of said V-shape together and retracted from beyond the end of said pole when said wire element is moved axially within said support means to said second, storage position, including wedge means at one end of said wire element support means for directing said wire element into a V shape in said first, operating position.

8. The device of claim 7, including releasable holding means for holding said wire element in said first, operating position.

9. The device of claim 7, said releasable line holding means formed by bending the ends of said wire element into line holding hooks.

10. A device for holding open a line loop at the end of a line and for extending and positioning said loop at the end of a long pole at a considerable distance from the user to encircle an object, comprising:

a substantially V-shaped wire element means having releasable line holding means at the two free ends of said V-shape;

wire element support means providing movement of said wire element means between a first, operating position and a second, storage position, said wire element support means disposed to direct and hold said wire element means in a V shape with the plane of said V shape substantially parallel to the axis of said pole with a major portion of said V shape extending beyond the end of said pole and with said V shape substantially free of impediments to its placement over said object to permit encirclement of said object by said line loop when said line loop is held by said two free ends of said V and said line is held alongside said pole in said first, operating position of said wire element means, said support means further disposed for securing said wire element means with said two free ends drawn together and retracted from beyond the end of said pole when said device is in said second, storage position;

and pole clamping means attached to said wire element support means for clamping said device to said pole for use.

11. In the device of claim 10, said releasable line holding means formed by bending the ends of said wire element means into line holding hooks.

* * * * *